US005607522A

United States Patent [19]

McDonnell

[11] Patent Number: 5,607,522

[45] Date of Patent: Mar. 4, 1997

[54] METHOD OF MAKING ELECTRICAL CONTACT MATERIAL

[75] Inventor: Donald G. McDonnell, Attleboro, Mass.

[73] Assignee: Texas Instruments Incorporated, Dallas, Tex.

[21] Appl. No.: 439,259

[22] Filed: May 11, 1995

Related U.S. Application Data

[62] Division of Ser. No. 66,600, May 24, 1993, which is a continuation of Ser. No. 810,641, Dec. 19, 1991, abandoned.

[51] Int. Cl.[6] ..... C23C 8/10

[52] U.S. Cl. ..... 148/281; 148/528; 148/431

[58] Field of Search ..... 148/281, 431, 148/528; 29/875, 877

[56] References Cited

U.S. PATENT DOCUMENTS

| | | | |
|---|---|---|---|
| 2,932,595 | 4/1960 | Pflumm . | |
| 3,571,546 | 3/1971 | Sedlak . | |
| 3,666,428 | 5/1972 | Haarbye | 148/431 |
| 3,933,485 | 1/1976 | Shibata . | |
| 3,933,486 | 1/1976 | Shibata . | |
| 4,647,322 | 3/1987 | Shibata | 148/431 |
| 4,695,330 | 9/1987 | Shibata | 148/281 |
| 4,803,322 | 2/1989 | Shibata . | |
| 4,846,901 | 7/1989 | Lima et al. | 148/678 |

FOREIGN PATENT DOCUMENTS

| | | | |
|---|---|---|---|
| 132358 | 9/1978 | German Dem. Rep. . | |
| 53-090132 | 8/1978 | Japan | 148/281 |
| 512516 | 9/1939 | United Kingdom | 148/281 |

*Primary Examiner*—David A. Simmons
*Assistant Examiner*—Margery S. Phipps
*Attorney, Agent, or Firm*—Russell E. Baumann; Richard L. Donaldson; René E. Grossman

[57] ABSTRACT

An electrical contact material having metal oxide particles dispersed in a silver metal matrix and having an easily brazeable backing layer is made free of internal oxide depletion zones by bonding a conventional internally oxidizable silver alloy to a thin backing layer of a second silver alloy to form a composite metal. The first silver alloy is selected to be internally oxidizable under selected oxidizing conditions. The second alloy is selected so that under the selected oxidizing conditions an oxygen-impenetrable barrier is quickly established on the surfaces of the composite formed by the second alloy. In that way, the first alloy layer is forced to be internally oxidized unidirectionally from the opposite surface of the composite to form the desired metal oxide dispersal extending substantially throughout the first alloy layer free of any internal oxide depletion zone in the first layer. An external scale that prevented internal oxidation from proceeding from the second layer surface is then easily removed from the remaining unoxidized silver alloy providing a means for attachment of the contact material by bonding or brazing.

7 Claims, 2 Drawing Sheets

METHOD OF MAKING ELECTRICAL CONTACT MATERIAL

This application is a division of application Ser. No. 08/066,600, filed May 24, 1993, which is a continuation of application Ser. No. 07/810,641, filed Dec. 19, 1991, now abandoned.

BACKGROUND OF THE INVENTION

The field of the invention is that of electrical contact materials, and the invention relates more particularly to metal-metal oxide contact materials adapted to display substantial electrical conductivity while also displaying resistance to contact erosion and contact welding over a long service life.

Electrical contact materials intended for high quality, long life performance in make and break devices and the like commonly comprise metal oxide particles dispersed in a matrix of a metal, such as silver, having high electrical conductivity. The presence of the metal oxide particles substantially increases the ability of the electrical contacts to resist welding together during opening and closing of electrical circuits. The presence of the metal oxide particles also reduces erosion of the contact surfaces during circuit opening and closing and extends the service life of the contacts. Some common metal-metal oxide materials of this type include silver cadmium oxide contact materials as shown in U.S. Pat. No. 2,932,595 and silver tin-indium oxide contact materials as shown in U.S. Pat. No. 3,933,485. It is common practice to bond a thin layer of a malleable and easily weldable or brazeable material of high electrical conductivity, such as fine silver, to one surface of the metal-metal oxide material for use in attaching the contact materials to contact arms and the like.

Metal-metal oxide contact materials are made by a variety of conventional processes. Typically, however, such known manufacturing procedures or contact materials are less than fully satisfactory for various reasons.

In one known procedure, for example, a compacted mixture of silver and metal oxide powders is sintered to form the desired contact materials. However, it is difficult to provide such contact materials with full density, and contact materials with less than full density do not display satisfactory uniformity of conductivity and service life.

In another known procedure, silver alloys with selected concentrations of cadmium, tin-indium or other oxide-forming constituents are bonded to a fine silver backing layer to form a composite. In that procedure, the cadmium, tin-indium or other oxide-forming constituents of the alloys, are selected and incorporated in particular concentrations in the alloys such that the alloys are internally oxidizable under conveniently selected internal oxidizing condition. The composite is then subjected to those selected oxidizing conditions to internally oxidize the cadmium or tin-indium constituents of the alloy layer. During that treatment, oxygen penetrates the silver materials from both sides thereof and a dispersal of cadmium oxide particles or the like is formed in situ in the silver alloy layer. Typically, however, there is some migration of the cadmium or other oxide-forming constituent of the alloy layer toward the two opposite external surfaces of the composite which are exposed to the oxidizing conditions with the result that the oxide-forming constituent is depleted in a central zone in the alloy before it is internally oxidized. As a result the dispersal of metal oxides does not extend through the material but leaves a centrally located internal oxide depletion zone. If the contact material is expected to undergo substantial contact erosion, there may be concern that the service life of the contact material may be shortened.

A number of known processes have been proposed or used to deal with the problem of such internal oxide depletion zones. In one procedure believed to be in common use for dealing with internal oxide depletion zones, two sheets of a silver cadmium alloy or similar material are hermetically sealed together along the edges of the two sheets. The resulting package is then exposed to internal oxidizing conditions so that the silver cadmium layers of the sheets are each internally oxidized from the outer surfaces inward leaving an oxide-free layer in each sheet adjacent the innermost surfaces of the sheets in the package. The sheets are then cut along their edges and separated to provide two contact materials, each being substantially free of an internal oxide depletion zone with an oxide-free surface region provided as a means of attachment. However, significant manufacturing cost is involved in securing the sheets together and then separating them, and there tends to be a waste of processed material along the secured edges of the sheets during separating of the two sheets after internal oxidation thereof.

In another process, layers of silver have been bonded to both outer surfaces of a silver cadmium metal alloy sheet or the like and the resulting composite has been exposed to selected oxidizing conditions for internally oxidizing the silver cadmium alloy layer. This procedure results in a centrally located oxide-free zone of the composite which is free of metal oxide particles, and the composite has been cut in half along its central axis so that the oxide-free zone is removed as the composite is cut in half producing separate sheets of internally oxidized contact material each having a fine silver backing layer to aid in attachment. Again, the cost of cutting the composite lengthwise of its core has been considered to add significantly to manufacturing expense.

In another process, a layer of nickel is bonded to one side of a silver cadmium alloy layer to prevent oxygen penetration of the silver cadmium alloy layer from that side of the composite, thereby to prevent occurrence of a centrally located internal oxide depletion zone. The oxidation process is terminated to leave an oxide-free zone adjacent the nickel layer. However, subsequent removal of the nickel layer to expose the unoxidized silver alloy portion as a backing layer for use in brazing the contact material to a support had been considered to add significantly to manufacturing expense for the noted process to be commercially practical.

BRIEF SUMMARY OF THE INVENTION

It is an object of the invention to provide novel and improved electrical contact materials; to provide such novel contact materials of metal-metal oxide structure; to provide such novel contact materials which are of high density; to provide such novel contact materials which are free of internal oxide depletion zones; to provide such novel contact materials which are made by internal oxidation in a novel and convenient manner; to provide such novel contact materials having easily weldable or brazeable backing layers; to provide novel and improved methods for making metal-metal oxide electrical contact materials; and to provide novel methods for making metal-metal oxide contact materials by internal oxidation to be free of internal oxide depletion zones.

Briefly described, the novel and improved electrical contact material of the invention comprises a composite material having a first outer surface layer of a metal-metal oxide material such as silver cadmium oxide, silver tin-indium oxide or the like bonded to a second opposite outer surface layer of a similar metal alloy such as silver tin, silver zinc or silver cadmium or the like. The first metal oxide layer has a dispersal of metal oxide particles in an electrically conductive metal matrix providing the contact material with desired electrical conductivity and resistance to contact welding and erosion. The metal-metal oxide layer typically comprises about 70 to 95% of the thickness of the contact material and is free of an internal oxide depletion zone so that the oxide dispersal in the metal matrix extends substantially through the first layer of the composite to provide the contact material with high electrical conductivity and with desired resistance to contact welding and erosion over a long source life. The metal of the second layer also displays high electrical conductivity and is easily brazeable or weldable for attaching the contact materials to a contact support. The metal alloy of the second layer is also characterized in that it quickly forms an easily removable barrier to oxygen penetration at surfaces of the second alloy layer which are exposed to selected oxidizing conditions as is described below.

The novel electrical contact material is made by bonding a first layer of a first metal alloy such as silver cadmium, silver tin indium or the like to a thin, second layer of a similar metal alloy such as silver tin, silver zinc or silver cadmium or the like to form a composite metal. The metal alloy of the first layer is selected to be internally oxidizable when exposed to selected internal oxidizing conditions. That is, the first metal alloy is selected so when it is exposed to an oxygen atmosphere for a substantial period of time at an elevated temperature, oxygen is able to penetrate those surfaces of the first metal alloy which are exposed to the atmosphere for internally oxidizing selected constituents of the first alloy in situ within the metal alloy to form a dispersal of metal oxide particles in a metal matrix of high electrical conductivity to provide the first layer with selected resistance to contact welding and erosion. The metal alloy of the second layer is selected to be easily brazeable or weldable and display high electrical conductivity exposed to the selected oxidizing conditions, an external oxide scale that serves as a barrier to oxygen penetration is quickly established at surfaces of the second layer which are exposed to the oxidizing conditions and so that the barrier is adapted to be easily removed thereafter from the surface or surfaces of the second layer. Preferably the first and second metal alloy layers are metallurgically bonded together to form the composite metal. If desired, the first and second metal alloy layers are bonded together with a thin interliner layer of a metal or alloy such as fine silver or the like which displays high electrical conductivity and is adapted to facilitate bonding the first and second metal alloy layers to form the composite metal. The composite metal is then subjected to the selected oxidizing conditions for forming the noted oxygen penetration barrier at the surface of the second layer exposed to the oxidizing conditions and for internally oxidizing the metal alloy of the first composite layer. In that arrangement, internal oxidation of the first metal alloy occurs solely as a result of oxygen penetration into the first metal alloy via those surfaces of the first alloy layer which are directly exposed to the selected internal oxidizing conditions. That is, there is unidirectional oxidation from one surface only. As a result, internal oxidation of the first alloy layer occurs substantially throughout the full thickness of the first layer of the composite metal to form a novel and improved electrical contact material, any oxide depletion in the first layer of the composite occurring only closely adjacent the bond interface between the first layer and the thin second or interliner layer at the opposite side of the composite. The oxygen-penetration barrier formed at exposed surfaces of the second layer is then easily removed by abrading or chemical reduction or the like to provide an easily brazeable or weldable surface on the contact material for use in attaching the contact material to a support, terminal or contact arm or the like.

In that way, the novel contact material is provided with full density, with high electrical conductivity, with excellent resistance to contact welding and erosion, and with a long service life. The contact material is easily and economically produced in a process which is easily adapted for continuous operation.

DESCRIPTION OF THE DRAWINGS

Other objects, advantages and details of the novel and improved contact materials and methods of the invention appear in the following detailed description of the preferred embodiments of the invention, the detailed description referring to the drawings in which.

DESCRIPTION OF THE PREFERRED EMBODIMENTS

Figure 1:
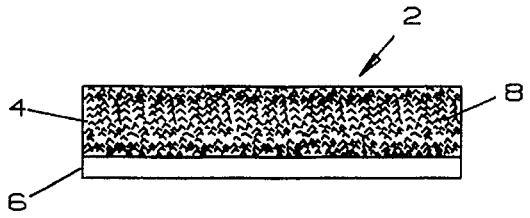
FIG. 1 is a section view along a prior art contact material illustrating a centrally located internal oxide depletion zone.

In a previously known, widely available metal-metal oxide contact material as shown at 2 in FIG. 1, a metal-metal oxide layer 4 is bonded to a fine silver backing layer 6. The layer 4 has metal oxide particles distributed in the layer as indicated by stippling but has a centrally located internal oxide depletion zone as indicated at 8 in FIG. 1.

Figure 2:
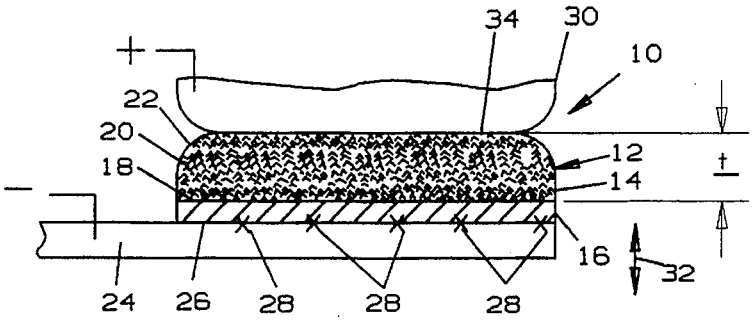
FIG. 2 is a section view through an electrical contact embodying the novel and improved electrical contact material of the invention.

Referring to the drawings, 10 in FIG. 2 indicates an electrical contact embodying the novel and improved electrical contact material 12 of the invention which is shown to include a first metal-metal oxide layer 14 bonded to a second, relatively thin metal alloy backing layer 16, the first and second layers of the contact material being bonded together along an interface 18 between the metal layers. The metal-metal oxide layer 14 comprises a multiplicity of metal oxide particles as indicated by the stippling 20 which are dispersed in a metal matrix as indicated at 22. The contact is shown mounted on a contact or support indicated at 24 by having the outer surface 26 of the backing layer 16 secured to the contact arm 24 by brazing or welding or the like as indicated at 28. As will be understood, the arm is adapted to be moved toward or away from a mating contact 30 as indicated by arrow 32 to open or close an electrical circuit.

The first layer 14 of the contact material comprises any conventional metal-metal oxide material having metal oxide particles 20 precipitated in a metal matrix 22 by internal oxidation so that the matrix material provides the layer 14 with good electrical conductivity and the metal oxide particles provide the layer 14 with good resistance to contact welding and contact erosion during opening and closing of the circuit. Preferably the layer 14 comprises a major part of the thickness of the contact material 12 and in a preferred embodiment comprises about 80 percent of the contact material thickness. The dispersal of the metal oxide particles 20 extends substantially through the thickness t of the layer 14 and the layer 14 is free of internal oxide depletion zones from a location at or closely adjacent to the outer surface 34 of the contact material substantially through the thickness t up to or closely adjacent to the interface 18 in the contact material.

The second layer 16 of the contact material comprises a metal alloy which is easily brazeable or weldable to a support 24 or the like and which displays high electrical conductivity, preferably comparable to the first layer 14. The alloy of the second layer is selected so that, if exposed to selected oxidizing conditions suitable for internally oxidizing the first alloy layer 14, the second layer alloy quickly establishes an easily removable barrier to oxygen penetration on surfaces of the second alloy which are exposed to the oxidizing conditions. Typically the second layer alloy 16 is generally similar to the material of the first layer 14 but is characterized by different diffusion kinetics as discussed below.

Preferably the first layer 14 embodies silver cadmium oxide as shown in U.S. Pat. No. 2,932,595 the disclosure of which is incorporated herein by this reference, that material having cadmium oxide particles dispersed in a silver metal matrix. Preferably the cadmium oxide constituent comprises about 5 to 20 percent by weight of the first layer to be internally oxidized in layer 14 under conveniently selected internal oxidizing conditions. In another preferred embodiment, the layer 14 comprises silver tin-indium oxide as shown in U.S. Pat. No. 3,933,485 the disclosure of which is incorporated herein by this reference, that material having a mixture of tin and indium oxides dispersed in a silver metal matrix. Preferably the layer 14 comprises a mixture of about 5.0 to 10.0 percent by weight tin and about 1.0 to 6.0 percent by weight indium. Other conventional internally oxidizing metal-metal oxide electrical contact materials such as alloys of silver zinc oxide and the like are also used in layer 14 within the scope of the invention.

Preferably the second layer alloy 16 is selected from the group consisting of silver tin, silver zinc and silver cadmium alloys and the like. The alloy is provided with an oxide-forming constituent such as tin, zinc or cadmium which is provided in sufficient concentration to provide the alloy with diffusion kinetics which substantially prevent oxygen penetration and internal oxidizing of the alloy except at or very near those surfaces of the alloy which are directly exposed to the selected oxidizing condition. That is, the tin, zinc or cadmium constituent or the like is selected to be rapidly oxidized at or closely adjacent to the surfaces of the alloy to quickly establish an easily removable tin oxide, zinc oxide or cadmium oxide barrier or the like to oxygen-penetration at the alloy surfaces for preventing further penetration of oxygen through the alloy material. In one preferred embodiment, the second layer alloy 16 comprises a silver tin alloy having from about 5 to 15 percent tin by weight. In another preferred embodiment, the second layer alloy 16 comprises a silver zinc alloy having from about 3 to 20 percent zinc by weight. In another preferred embodiment, the alloy layer 16 comprises a silver cadmium alloy having from about 20 to 35 percent cadmium by weight. In each of those cases, the alloy layer 16 is adapted to form a very thin and somewhat frangible oxygen-penetration barrier of tin oxide, zinc oxide or cadmium oxide on surfaces of the layer which are subjected to those oxidizing conditions conventionally used for internally oxidizing contact materials.

Figure 3:
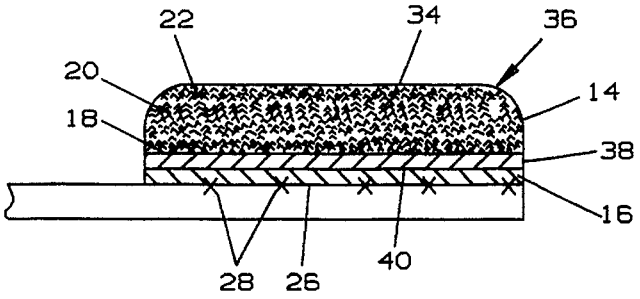
FIG. 3 is a section view similar to FIG. 2 illustrating an alternate embodiment of the electrical contact material of the invention.

Another preferred embodiment of the electrical contact material of the invention is shown at 36 in FIG. 3 wherein components of the contact material 12 are indicated with corresponding reference numerals. In this other embodiment of the invention, an interliner layer 38 is disposed between the outer surface layers 14 and 16 of the contact material and is metallurgically bonded to the layers 14 and 16 along bond interfaces 18 and 40. Typically, for example, where the surface layers 14 and 16 comprise silver materials, the interliner layer comprises a very thin layer of fine silver or silver alloy or the like to facilitate bonding the layers 14 and 16 to each other. Preferably the interliner comprises not more than about 5 percent of the thickness of the contact material.

Figure 4A:
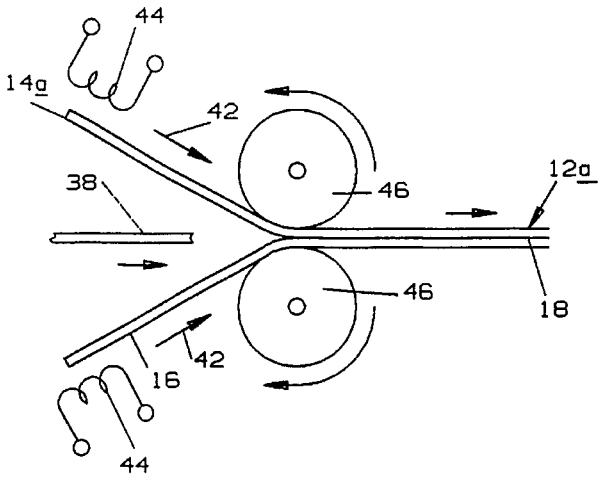
FIGS. 4A–4C are diagrammatic views illustrating steps in the novel and improved method of the invention for making the contact materials of FIGS. 2 and 3.

The contact material 12 is made by bonding a first metal alloy layer **14*a* to the second metal alloy layer 16 in any conventional manner to form a composite metal member 12*a* as is diagrammatically illustrated in FIG. 4A. Preferably, for example, strips or elements of the first metal alloy 14*a* and the second metal alloy 16 are advanced from respective pay-off reels (not shown) as indicated by arrow 42. The strips are heated as is diagrammatically shown at 44 preferably to a temperature between 7000° and 1450° F. and are pressed together between pressure bonding rolls 46 to be bonded together along the interface 18 in any conventional manner. The metal alloy layers are preferably reduced in thickness between the bonding rolls to be metallurgically bonded together and if desired are further rolled to provide the composite metal 12*a* with a desired thickness. In other alternate processes, sheets of the first and second metals are welded together to form a package one on top of the other and are heated. The package is then hot rolled to size to complete bonding between the first and second metals. If desired, the bonding is carried out in a protective or non-oxidizing atmosphere. Preferably the first metal alloy layer comprises from about 70 to 95 percent of the thickness of the composite metal 12*a* although the backing layer 16 need only be as thick as required (typically about 0.001 to 0.003 inches) to form an oxygen barrier scale. Typically, for example, the layer 14*a* has a thickness in the range from about 0.020 to 0.200 inches and the layer 16 has a thickness in the range from about 0.002 to 0.050 inches. Although the strips are shown being metallurgically bonded together in a conventional hot roll bonding step, it should be understood that the strips 14*a* and 16 are bonded together by any conventional means within the scope of the invention. Where the contact material 36 is to be made, a conventional manner to form a composite metal member 12*a* as is diagrammatically illustrated in FIG. 4A. Preferably, for example, strips or elements of the first metal alloy 14*a* and the second metal alloy 16 are advanced from respective pay-off reels (not shown) as indicated by arrow 42. The strips are heated as is diagrammatically shown at 44 preferably to a temperature between 7000° and 1450° F. and are pressed together between pressure bonding rolls 46 to be bonded together along the interface 18 in any conventional manner. The metal alloy layers are preferably reduced in thickness between the bonding rolls to be metallurgically bonded together and if desired are further rolled to provide the composite metal 12*a* with a desired thickness. In other alternate processes, sheets of the first and second metals are welded together to form a package one on top of the other and are heated. The package is then hot rolled to size to complete bonding between the first and second metals. If desired, the bonding is carried out in a protective or non-oxidizing atmosphere. Preferably the first metal alloy layer comprises from about 70 to 95 percent of the thickness of the composite metal 12***a* although the backing layer 16 need only be as thick as required (typically about 0.001 to 0.004 inches) to form an oxygen barrier scale. Typically, for example, the layer 14*a* has a thickness in the range from about 0.020 to 0.200 inches and the layer 16 has a thickness in the range from about 0.002 to 0.050 inches. Although the strips are shown being metallurgically bonded together in a conventional hot roll bonding step, it should be understood that the strips 14*a* and 16 are bonded together by any conventional means within the scope of the invention. Where the contact material 36 is to be made, a strip 38 of the interliner material is fed from a corresponding pay-off reel (not shown) to be metallurgically bonded to the strips 14*a* and 16 between the rolls 46 as will be understood.

The metal alloy used in the first metal strip 14*a* comprises any conventional metal alloy in which metal oxides are adapted to be precipitated by internal oxidation within an electrically conductive metal matrix to form the metal-metal oxide layer 14 of the contact material 12 as above described. For example, where the layer 14 is to comprise silver cadmium oxide as shown in U.S. Pat. No. 2,932,595, the metal alloy strip 14*a* preferably comprises from about 4 to 18 percent cadmium by weight, the balance being silver. Alternately, where the layer 14 is to comprise silver tin-indium oxide as shown in U.S. Pat. No. 3,933,485, the metal alloy strip 14*a* comprises from about 5 to 10 percent by weight tin and from 1.0 to 6 percent by weight indium and the balance silver.

Figure 4B:
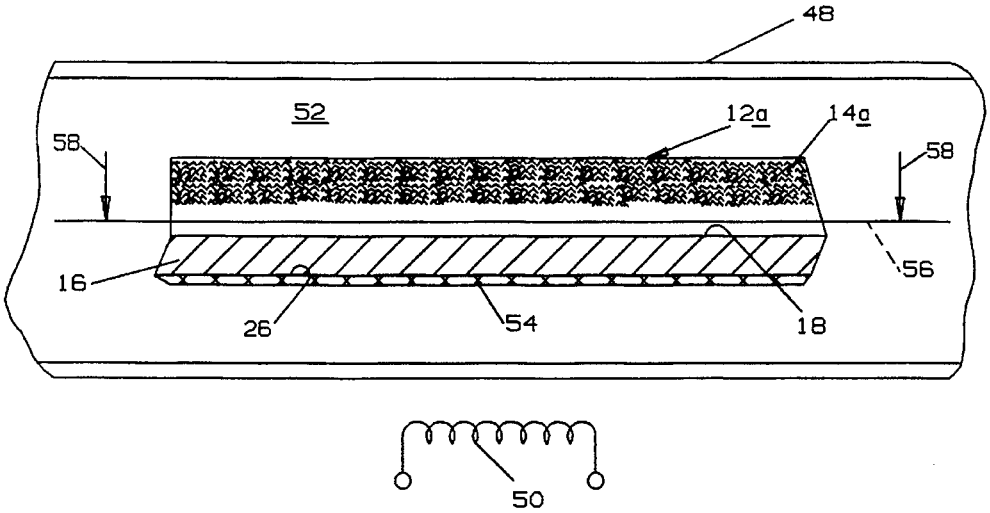

The composite metal strip member 12*a* is then disposed or passed through a conventional internal oxidation oven as indicated diagrammatically at 48 in FIG. 4B wherein the strip 12*a* is heated as shown at 50 to a temperature in the range from about 10000° to 1600° F. for a sufficient period of time to achieve a desired depth of internal oxidation while an oxygen atmosphere 52 is maintained in the oven. Preferably the oxygen atmosphere 52 is in the range from about 0.21 atmosphere (standard oxygen pressure in air) to about 10 atmospheres. Typically the composite metal strip 12*a* is maintained in the oven 48 under the selected oxidizing conditions which are conventionally used for internally oxidizing the metal alloy strip 14*a* to produce the desired metal-metal oxide layer 14 in the contact material 12. In the method of the present invention, an oxygen-penetration barrier of metal oxides is quickly established on the surface 26 of the second alloy layer 16 which is exposed to the oxygen atmosphere as is diagrammatically illustrated at 54 in FIG. 4B. Typically, for example, where the second layer alloy 16 comprises silver tin as above-described, the barrier 54 preferably comprises a surface oxide within about 0.002 inches of the surface 26, the barrier being substantially formed of tin-oxide which is somewhat frangible. In that treatment, the metal alloy 14*a* is penetrated by oxygen through the surface 34 thereof along one side of the composite metal 12*a* for internally oxidizing the metal alloy 14*a* substantially independent of internal oxidizing thereof through the layer 16. As the treatment continues the oxygen penetration proceeds along the oxygen front indicated at 56 in FIG. 3B moving toward the interface 18 as indicated by the arrows 58 until the oxygen front 56 reaches the interface 18 or preferably is spaced a short distance from the interface 18, thereby to substantially fully oxidize the metal alloy 14*a* to form the metal-metal oxide layer 14 substantially free of any centrally located internal oxide depletion zone in the layer 14. The oxidizing treatment is then preferably terminated.

Figure 4C:
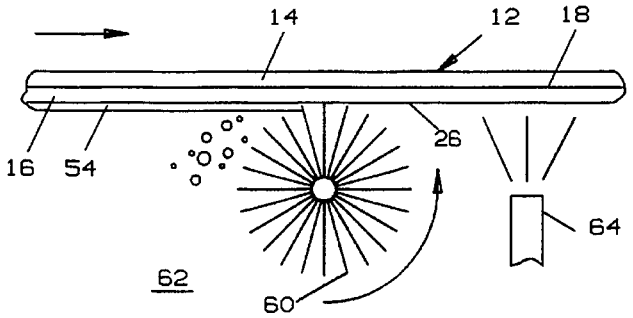

The barrier 54 is then removed from the contact material 12 as shown at 60 in FIG. 4C so that the surface 26 of the contact material is adapted to be easily welded or brazed to a support 24 or the like. In a preferred embodiment of the method, for example, the surface 26 of the contact material is wire brushed or abraded as indicated at 60 for removing the oxygen penetration barrier. In an alternate embodiment of the invention, the barrier 54 is removed by exposing the contact material surface 26 to a chemical reduction means such as a reducing atmosphere of hydrogen or the like as indicated diagrammatically at 62 in FIG. 3C. Alternately, the surface 26 is subjected to a bath or spray of an etching agent such as nitric acid or the like as is indicated at 64 in FIG. 3C for etching the barrier from the contact material. If desired, the barrier 54 is removed by a combination of wire brushing and chemical reduction as will be understood. In that procedure, the contact material 12, or the contact material 36 if a three layer material is preferred, is provided with a metal-metal oxide layer 14 substantially free of internal oxide depletion zones and the surface 26 of the contact material is easily prepared to be brazed or welded to a contact support 24 or the like. If desired, the composite material 12*a* is passed through the described process steps in a continuous process.

EXAMPLE A

In an exemplary embodiment, for example, a strip of silver cadmium metal alloy 14*a* comprising from about 9.0 percent by weight cadmium is metallurgically bonded to a silver tin metal alloy layer 16 comprising about 7.5 percent by weight tin to form the composite metal 12*a*. The layer 14*a* has a thickness of about 0.040 inches and the layer 16 has a thickness of about 0.010 inches for a total composite thickness of 0.050 inches. The composite metal is heated to a temperature of about 1550° F. for 10 hours in an oxygen atmosphere at 3 times atmospheric pressure for internally oxidizing the metal alloy 14*a* to form a metal-metal oxide layer 14 having about 10 percent cadmium oxide by weight, the cadmium oxide being dispersed through the layer 14 free of internal oxide depletion zones. A barrier layer formed on the outer surface of the metal alloy layer 16 during that oxidizing treatment is removed by wire brushing with a Scotch Brite wire brushing wheel. The outer surfaces of the layer 16 in the resulting contact material is a silver alloy free of oxide and easily brazeable to a copper contact support. The contact material displays 80 percent of IACS electrical conductivity.

EXAMPLE B

In another exemplary embodiment, strips of metal alloy 14*a* and 16 as described with reference to Example A are metallurgically bonded together with a fine silver interliner layer having a thickness of about 0.005 inches and the resulting composite metal is subjected to selected oxidizing conditions and to barrier removal as described with reference to Example A to form an electrical contact material. Again the contact material comprises a surface layer of metal-metal oxide material free of internal oxide depletion zones down to the interliner layer in the contact material and the opposite outer surface layer of the contact material is a silver alloy free of oxide and easily brazeable to a contact support. The contact material displays electrical conductivity comparable to Example A.

EXAMPLE C

In another exemplary embodiment, a strip of silver tin-indium metal alloy comprising 6.0 percent by weight tin and 4.0 by weight indium is metallurgically bonded to a strip of silver tin metal alloy having 7.5 percent tin by weight to form a composite metal. The silver tin-indium layer has a thickness of about 0.090 inches and the silver tin alloy layer has a thickness of about 0.010 inches for a total composite thickness of 0.100 inches. The composite metal is heated to a temperature of 1550° F. for 50 hours in an air atmosphere at 3 times atmospheric pressure for internally oxidizing the silver tin-indium metal alloy and for forming an oxygen penetration barrier on an outer surface of the silver tin alloy layer. The oxygen-penetration barrier is then removed by wire brushing as above-described and is further etched with nitric acid in concentration of 20 percent for 1 minute. The resulting contact material has a layer of silver tin-indium oxide at one surface of the contact material substantially free of internal oxide depletion zones therein and the opposite surface of the contact material is a silver alloy free of oxide and easily brazeable. The oxide dispersal extends from that surface to the interface with the silver tin alloy layer free of any significant oxide depletion zone.

EXAMPLE D

In another exemplary embodiment, a first strip of silver cadmium metal alloy comprising about 9.0 percent by weight cadmium is metallurgically bonded to a second strip of silver cadmium metal alloy comprising about 20 percent by weight cadmium to form a composite metal, the composite having layer thicknesses as in Example A. The composite metal is subjected to selected oxidizing conditions as in Example A for internally oxidizing the first silver cadmium strip and for forming an oxygen-penetration barrier on the exposed surface of the second strip to form an electrical contact material. The barrier is removed by wire brushing and by a nitric acid etch. The contact material comprises an internally oxidized silver cadmium oxide layer substantially free of internal oxide depletion zones and the opposite surface layer of the contact material is an oxide-free silver alloy easily brazeable to a support.

EXAMPLES E AND F

In other exemplary embodiments, first strips of silver cadmium metal alloy comprising 12.0 percent cadmium and 13.5 percent cadmium are respectively bonded to second strips of silver tin metal alloy having 7.5 percent tin by weight for forming respective composite metals. The layer thicknesses are 0.040 and 0.010 inches respectively for a total composite thickness of 0.050 inches. The composite metals are subjected to selected oxidizing conditions as described in Example A for periods of 15 and 20 hours respectively to internally oxidize the silver cadmium alloys and to form an oxygen-penetration barrier on the exposed surfaces of the silver tin alloy strips. The barriers are removed by wire brushing and a nitric acid etch. The resulting contact materials each include silver cadmium oxide layers along one side of the contact materials free of internal oxide depletion zones and each have an opposite surface which is a silver alloy free of oxide and easily brazeable. The contact materials display 70 and 60 percent of IACS electrical conductivity respectively.

It should be understood that although exemplary embodiments of the contact materials and methods of the invention are described by way of illustrating the invention, the invention includes all modifications and equivalents of the disclosed embodiments falling within the scope of the appended claims.

I claim:

1. A method for making electrical contact materials comprising the steps of:

providing a composite metal member having a first electrically conductive metal layer with a first external surface portion as part of said member and a second different easily-brazeable electrically-conductive metal layer metallurgically bonded to the first layer with a second external surface portion as part of said member, the first metal layer selected to be internally oxidizable to form metal oxide particles dispersed in the first metal layer when subjected to selected oxidizing conditions, the second metal layer selected to form a barrier to internal oxidizing at the second surface portion when subjected to said selected oxidizing conditions, said selected oxidizing conditions being the required time and temperature in an oxygen atmosphere to internally oxidize the metal in the first layer into metal oxide particles dispersed in the metal layer;

subjecting the composite member to said selected oxidizing conditions, thereby internally oxidizing substantially the entire first metal layer through the first external surface portion while forming the barrier to internal oxidizing in the second metal layer on the second external surface portion, said internal oxidizing of the first layer occurring substantially only through said first external surface portion and not also the second external surface portion so as to not provide any centrally located depletion zone in the first layer; and removing the barrier from the second external surface portion of the metal member to provide contact materials with an easily-weldable mounting surface.

2. A method according to claim 1 wherein the first metal layer comprises an alloy of silver and a constituent part thereof internally oxidizable in the first metal layer selected from the group consisting of cadmium, tin, indium, and zinc and mixtures thereof, and wherein the second metal layer comprises an alloy of silver and a constituent part thereof present in sufficient concentration to form said internal-oxidizing barrier selected from the group consisting of cadmium, tin and zinc.

3. A method according to claim 2 wherein an additional layer of silver metal is metallurgically bonded between the first and second metal layers to form the metal member.

4. A method according to claim 2 wherein the internal-oxidizing barrier is removed by wire brushing the second surface portion of the metal member.

5. A method according to claim 2 wherein the internal-oxidizing barrier is removed by exposing the the second surface portion of the metal member to a reducing agent.

6. A method according to claim 2 wherein the first metal layer is selected from the group consisting of an alloy of cadmium and silver and an alloy of tin, indium and silver, and the second metal layer is selected from the group consisting of an alloy of tin and silver, an alloy of zinc and silver, and an alloy of cadmium and silver.

7. A method according to claim 6 wherein the internal-oxidizing barrier is formed within 0.001 to 0.003 inches of the second surface portion of the metal member.

* * * * *